United States Patent [19]

Szabo

[11] 4,278,232

[45] Jul. 14, 1981

[54] REMOVABLE SEISMIC GAP FILLER

[76] Inventor: Gustav Szabo, c/o Progress Unlimited, 200 Madison Ave., New York, N.Y. 10016

[21] Appl. No.: 123,511

[22] Filed: Feb. 22, 1980

[51] Int. Cl.[3] ..... B28B 7/30

[52] U.S. Cl. ..... 249/183

[58] Field of Search ..... 249/183

[56] References Cited

U.S. PATENT DOCUMENTS

| | | | |
|---|---|---|---|
| 3,052,945 | 9/1962 | Cummings | 249/183 X |
| 3,567,171 | 3/1971 | Slominski | 249/183 X |
| 4,040,598 | 8/1977 | Cheron | 249/183 X |

*Primary Examiner*—J. Howard Flint, Jr.

[57] ABSTRACT

The disclosure of this specification illustrates a GAP FILLER, designed to be easily and quickly removed from the gap between poured concrete sections, after the concrete sets. The individual plastic-foam slats, held together and attached to each other, are packaged in a watertight polyethylene bag, and are positioned against an existng concrete wall, ready to receive the second concrete pour. The zip-out filler will form the expansion joint between the two concrete pours. Removal of the filler is easily accomplished because of the interconnected slats.

12 Claims, 10 Drawing Figures

REMOVABLE SEISMIC GAP FILLER

The field of this invention lies within the field of seismic gap fillers. Due to recent changes in government regulations, many of the seismic gaps in concrete walls have to be left open, to assure unimpaired movement. In other instances, the already installed seismic gap fillers, which are flammable, must be removed to prevent fire hazards and toxic fumes. These fillers have been used for years on various nuclear power plants, and projects subjected to seismic movement.

Many owners and contractors have experienced considerable difficulties in removing the already embedded seismic gap fillers from depths up to ten, fifteen and even twenty feet. Currently, costly and time consuming removal procedures are used, such as dissolving the filler, cutting it and removing it piece by piece mechanically, or with lasers or jet streams.

In contrast, this invention provides a collapsible seismic gap filler, made of layers of compressible resilient slats, held together by a strong tape, or other methods, enabling the filler to be in one continuous piece. This zip-out method makes it possible to pull out easily the filler from the joint or seismic gap between poured concrete walls, even when compressed up to twenty percent of its original thickness. The individual slats one-half inch to two inch thick, when pulled from the horizontal to a vertical position, can be removed, without effort, within minutes, even from a depth of fifteen to twenty feet. The filler can be made to fit joint widths from one-half inch to six or nine inches, and in lengths of fourty-eight inches and heights up to twenty or twenty-five feet.

To facilitate the removal further, and to cut down on the friction between the gap-filler and concrete surfaces, the zip-out filler is completely enclosed in large plastic bags. These bags are attached to the existing wall (or first pour), and held in vertical position at the top of the wall. The pressure of the freshly poured concrete will keep the bags firmly in their vertical positions. The plastic bag also will prevent the still liquid concrete from seeping between the slats.

After the concrete has set, the top of the plastic bags are cut open, and, with already-provided "pull tabs", the slats are easily and quickly pulled out of the gap. An entire filler can be removed within two to three minutes. After the filler is removed from the joint, it can be refolded in its zig-zag flat position, reinserted into a new plastic bag and reused.

It is, therefore, the principal object of this invention to provide a gap-filler, that can be easily and quickly removed from any size seismic gap between poured concrete walls.

Another object of this invention is to reduce the costs of seismic gap fillers, by providing one that can be reused by reinserting the filler into a new plastic bag, like the one in which the filler is originally enclosed.

A still further object of this invention is to provide a removable seismic gap filler.

These, and other objects, will be readily evident, upon a study of the following specification, and the accompanying drawings, wherein.

Figure 1:
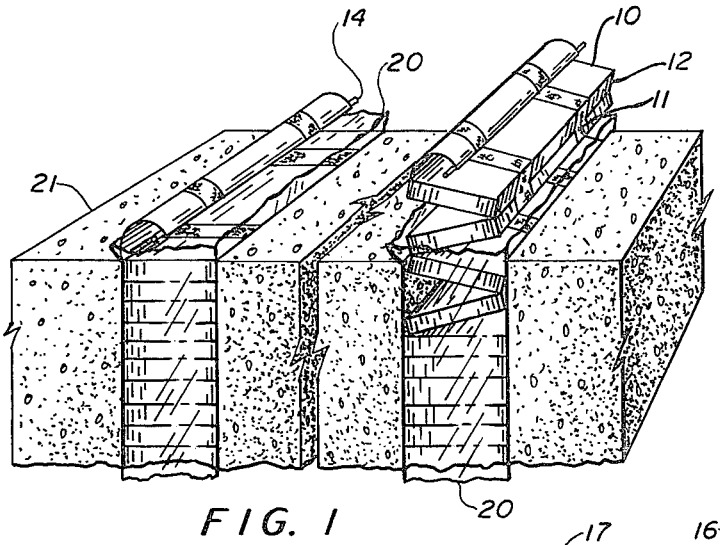
FIG. 1 is a perspective view of the zip-out filler in a plastic bag in use; and another filler in the plastic bag in place, and in the process of being removed by pulling the slats, joined by tape on the sides, out of the gap.

According to this invention, (see FIG. 1) resilient slats 10 are joined by strong plastic tape 11, in such a manner as to easily stack the slats, and yet remove them in one continuous strip. The tape 11 is attached to every other side of the resilient slat, either on the side 12, or on the end of the slat 13. A peice of wood 14 may be attached at the top slat, to facilitate removal of the slats.

Figure 4:
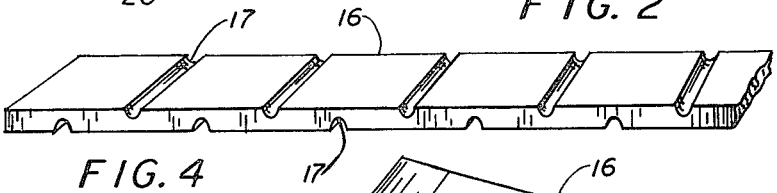
FIG. 4 is a perspective view of part of a piece of filler, stretched out to show another method of construction, using foam crimped at designated intervals.
Figure 3:
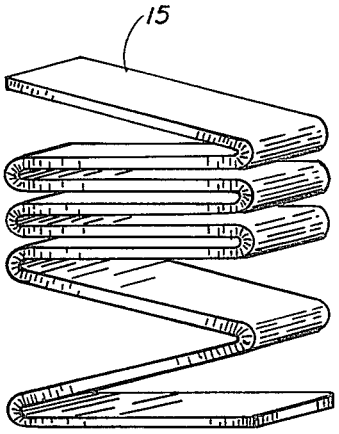
FIG. 3 is a perspective view of still another method of construction, showing one continuous ribbon of foam and folded at designated intervals.
Figure 5:
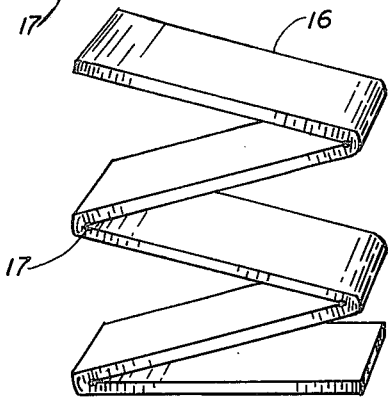
FIG. 5 is a perspective view of the crimped foam strip of FIG. 4, shown folded at the crimps.

There are several alternate methods of folding construction of the resilient strips. The foam strip 15 (see FIG. 3) could be just folded, at designated intervals, to produce slats in an endless ribbon, or the resilient slats 16 could be formed by crimping 17 (FIGS. 4 and 5), at designated intervals, alternating on both sides.

Figure 6:
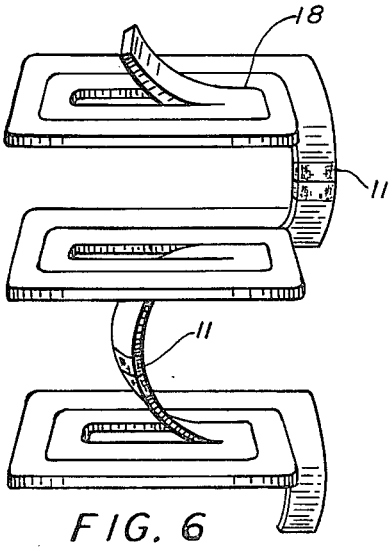
FIG. 6 is a perspective view of another method of construction of the foam filler, employing a die-cut slat in a coil to form an endless ribbon with the slat ends of one slat attached by strong tape to the ends of another slat.

Another method of forming slats in a continuous ribbon would be to die-cut the slats in a coiled design (FIG. 6), fastening the ends of each slat to the next with strong tape 11*a*.

Figure 7:
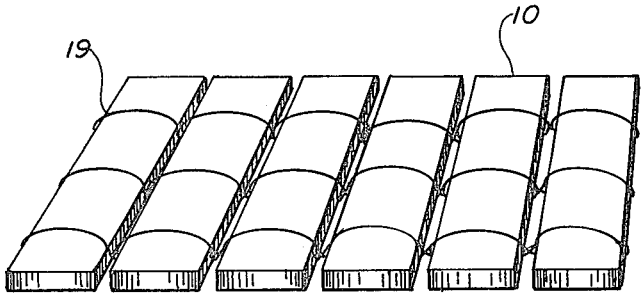
FIG. 7 is a perspective view of yet another method of construction of the foam filler, employing interwoven cord or tape to join the slats, yet permitting stacking them.
Figure 8:
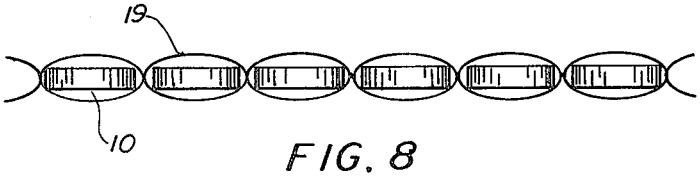
FIG. 8 is a side view of the interwoven construction of the resilient slats of FIG. 7.

Still another method of construction would be to weave cord or tape 19 (FIGS. 7 and 8) through the slats 10, so that they could be easily stacked, and easily pulled out of the seismic gap.

Figure 9:
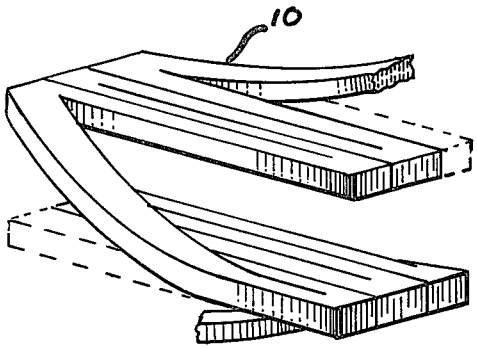
FIG. 9 is a perspective view of another method of construction, employing a zig-zag cut.
Figure 10:
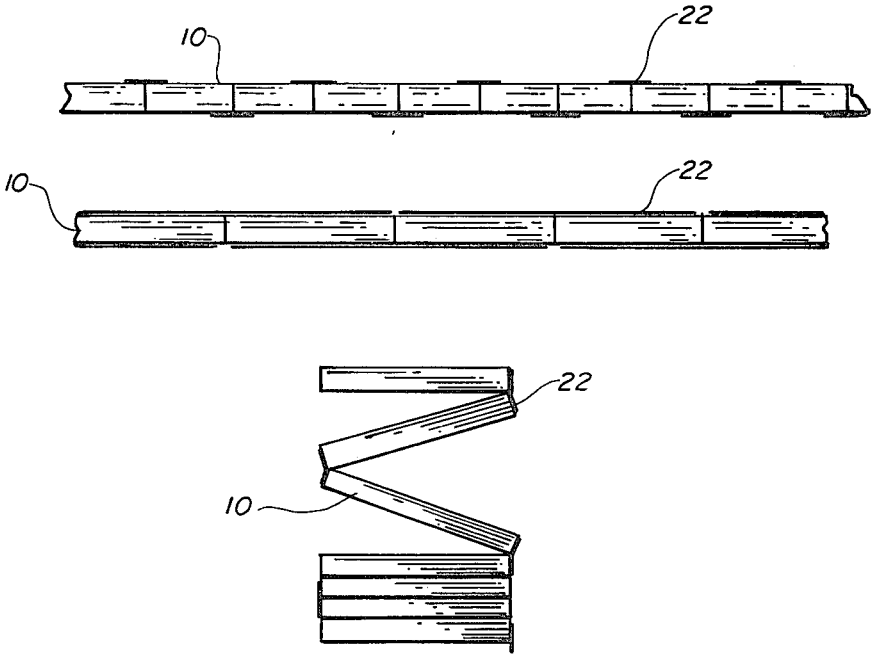
FIG. 10 shows three side elevational views of the filler (a) connected by intermittent tape over each end, (b) continuous tape cut at every second slat, and (c) folded for use.

FIG. 9 illustrates construction of the filler, by die cutting the slats 10 in a zig-zag design, and FIG. 10 illustrates securing the slats 10, by means of tape 22, either using short tape on alternate joints, or a continuous tape 22*a* on both sides, and cut at every second slat alternately.

Figure 2:
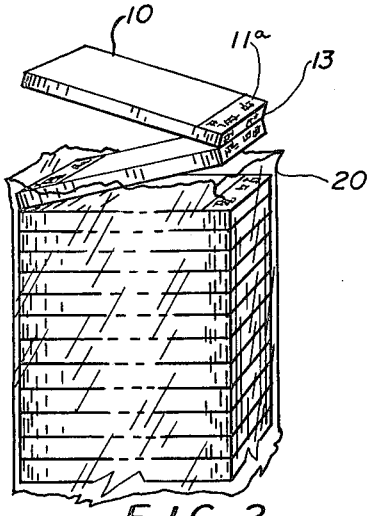
FIG. 2 is a perspective view of another method of construction of the filler strip, showing the slats assembled by taping each slat together at the end of the slats, all enclosed in a plastic bag.

The stacked slats are put into a plastic bag 20 (FIG. 2), which is opened after the concrete 21 (FIG. 1) has set. The filler is more easily removed, because the plastic bag 20 prevents friction between the concrete 21 and the resilient slats 10. This plastic bag 20 also prevents concrete from seeping between the slats.

The bags 20 of filler resilient slats 10 are installed by attaching to an existing wall by an adhesive, and held in a vertical position at the top of the wall. The pressure of freshly poured concrete will keep the bags firmly in their vertical position. If more than one bag is used, four inch wide polyethelene tape can be applied where the two bags meet, covering the seam they make, and thus preventing concrete seepage between the two bags.

These bags of filler can be made in units four feet long, up to twenty feet high and up to nine inches thick.

While various changes may be made in the detail construction, it is understood that such changes will be within the scope of the present invention, as is defined by the appended claims.

What I now claim is:

1. A removable seismic gap or expansion joint filler, comprising a continuous strip, said strip being adapted to form a zig-zag filler in poured concrete that is easy to remove from the seismic gap, or joint after the poured concrete sets.

2. A removable seismic gap, or joint filler, according to claim 1, wherein said continuous strip comprises a plurality of resilient slats, and tapes attached to the sides of said resilient slats, whereby said resilient slats may be piled in zig-zag fashion.

3. A removable seismic gap, or joint filler, according to claim 1, wherein said continuous strip comprises a plurality of resilient slats, and tapes attached on the ends of said resilient slats, whereby the latter may be piled in zig-zag fashion.

4. A removable seismic gap, or joint filler, according to claim 1, wherein said continuous strip comprises a plurality of slats, each of said slats being die-cut in a circle, and tapes or adhesive connecting the ends of said slats at alternate ends, whereby said resilient slats may be piled in zig-zag fashion.

5. A removable seismic gap, or joint filler, according to claim 1, comprising a plurality of resilient slats, and string fastening means being tied in loops longitudinally along said slats whereby to permit the slats to assume a zig-zag filler in poured concrete, that is easy to remove from the seismic gap, or joint after the poured concrete sets.

6. A removable seismic gap, or joint filler, according to claim 1, said continuous strip being crimped on spaced, alternate sides, wherein said continuous strip may be formed into a zig-zag filler.

7. A removable seismic gap, or joint filler, according to claim 1, wherein said continuous strip comprises a resilient material, adapted to be folded into the said zig-zag position, by merely folding at designated intervals.

8. A removable seismic gap, or joint filler, according to claim 1, including a polyetheylene or other plastic or rubber bag, as a container for the said zig-zag strip, whereby said bag makes handling and shipping simpler, and eliminates friction between the concrete and said resilient slats, during the removal of said slats.

9. A removable seismic gap, or joint filler, according to claim 7, whereby said filler can be reused after removal from the gap by refolding in zig-zag position, said strips, after refolding, being inserted into a new plastic or rubber bag, ready for re-usage.

10. A removable seismic gap, or joint filler, according to claim 1, wherein said filler comprises a plurality of juxtaposed slats, and intermittent tape connecting the ends of said slats.

11. A removable seismic gap, or joint filler, according to claim 1, wherein said filler comprises a plurality of juxtaposed slats, and continuous tape connecting the ends of said slats.

12. A removable seismic gap, or joint filler, according to claim 1, wherein said continuous strip comprises a plurality of slats, each of said slats being die-cut to form a ribbon, attached to each other with tape.

* * * * *